US011884455B2

(12) United States Patent
Jiménez Gálvez

(10) Patent No.: US 11,884,455 B2
(45) Date of Patent: Jan. 30, 2024

(54) CAP FOR AN OPENING OF A CONTAINER

(71) Applicant: COMPAÑÍA DE TAPONES IRRELLENABLES, S.A., Cadiz (ES)

(72) Inventor: Eduardo Jiménez Gálvez, Cadiz (ES)

(73) Assignee: COMPAÑÍA DE TAPONES IRRELLENABLES, S.A., Cadiz (ES)

( * ) Notice: Subject to any disclaimer, the term of this patent is extended or adjusted under 35 U.S.C. 154(b) by 0 days.

(21) Appl. No.: 17/773,854

(22) PCT Filed: Nov. 6, 2019

(86) PCT No.: PCT/ES2019/070754
§ 371 (c)(1),
(2) Date: May 3, 2022

(87) PCT Pub. No.: WO2021/089889
PCT Pub. Date: May 14, 2021

(65) Prior Publication Data
US 2022/0371784 A1 Nov. 24, 2022

(51) Int. Cl.
*B65D 39/00* (2006.01)

(52) U.S. Cl.
CPC ..... *B65D 39/0058* (2013.01)

(58) Field of Classification Search
CPC ..... B65D 39/0058; B65D 39/16; B65D 39/0076; B65D 39/0052; B65D 41/28; B65D 39/00
See application file for complete search history.

(56) References Cited

U.S. PATENT DOCUMENTS

| | | | | |
|---|---|---|---|---|
| 2,220,580 | A * | 11/1940 | Penn | B65D 39/16 215/364 |
| 3,559,834 | A | 2/1971 | Taylor | |
| 5,803,285 | A * | 9/1998 | Hirota | B65D 39/16 81/3.15 |
| 9,114,912 | B2 * | 8/2015 | Giovannini | B65D 39/0052 |
| 11,214,409 | B2 * | 1/2022 | Rossi | B65D 39/16 |
| 2015/0060389 | A1 * | 3/2015 | Bolger | B65D 41/045 215/355 |
| 2019/0283944 | A1 * | 9/2019 | Giovannini | B65D 55/026 |

FOREIGN PATENT DOCUMENTS

| | | | |
|---|---|---|---|
| DE | 20119241 | U1 | 5/2002 |
| EP | 2417032 | A2 | 2/2012 |
| WO | 2004050494 | A1 | 6/2004 |

* cited by examiner

*Primary Examiner* — Shawn M Braden

(57) ABSTRACT

The present invention relates to a cap for covering an opening of a container, preferably the opening of a bottle. The present invention is characterized by a cork body having a cylindrical configuration and configured in two portions between which there is arranged an impermeable sheet element according to the longitudinal direction. The presence of an impermeable sheet allows using a conventional closure material preventing permeability in the longitudinal direction both to prevent the liquid from coming out of the container and to prevent bacteria or contaminants from the outside from entering.

13 Claims, 4 Drawing Sheets

CAP FOR AN OPENING OF A CONTAINER

OBJECT OF THE INVENTION

The present invention relates to a cap for covering an opening of a container, preferably the opening of a bottle.

The present invention is characterized by a cork body having a cylindrical configuration and configured in two portions between which there is arranged an impermeable sheet element according to the longitudinal direction.

The presence of an impermeable sheet allows using a conventional closure material preventing permeability in the longitudinal direction both to prevent the liquid from coming out of the container and to prevent bacteria or contaminants from the outside from entering.

BACKGROUND OF THE INVENTION

The closing of bottles by means of a cylindrical piece of cork is common in the wine industry.

Pieces of this type are obtained from sheets of cork removed from the cork tree. The pieces of higher value are configured into a single piece, so the sheet of cork must be suitably cut to obtain pieces with suitable dimensions, and so that the resulting pieces are furthermore free of defects.

The most common are cracks or irregularities, holes which allow the passage of liquid therethrough, or heterogeneities which mean that the resulting piece will not assure the tightness of the closure when the piece of cork is used to close the opening of a bottle.

The existence of cavities which are not easily visible means that there may be harbored therein bacteria or fungi which are transferred to the liquid, ruining the bottled product.

A common way to prevent drawbacks of this type consists of grinding the cork, forming granules of a certain size which are compacted and bound by means of adhesive. The result is a piece the dimensions of which are easier to obtain and does not require human intervention to find the best cutting position to obtain a single piece from an irregular sheet such as the bark of the cork tree.

However, these aggregated pieces are not so highly valued and present the problem of migration of the adhesive into the container, and therefore into the liquid.

In any case, the use of a material which can have heterogeneities such as cork always presents a certain degree of diffusion between the outside and the inside which cannot be determined entirely during manufacture.

The present invention solves the preceding problems since it requires smaller pieces and furthermore assures in all cases that there is no diffusion between the inside and the outside of the container.

DESCRIPTION OF THE INVENTION

The invention solves the problems identified above with a specific cap configuration intended for covering or closing an opening of a container, preferably a bottle, wherein said cap comprises:

- a cork body having a cylindrical configuration extending along a longitudinal direction, wherein the cork body comprises a first portion intended for being inserted into the opening of the container and a second portion intended for being accessible from the outside when the cap closes the opening of the container in the operative mode;

- an impermeable sheet element, arranged between the first portion and the second portion configured to prevent the passage of a fluid or gas between the first portion and the second portion.

The longitudinal direction is the main direction of the opening of the container and also the main direction of the cap. Following this main direction, the invention uses a cork body having a cylindrical configuration formed by two portions, a first portion that is housed in the opening of the container when the cap is operatively closing said opening, and a second portion that is exposed to the exterior. According to several embodiments, these two portions can have a different diameter.

Cylindrical configuration is generally understood to mean any configuration the side wall of which is the result of the rotation of a generatrix around an axis extended according to the longitudinal direction. This generatrix is preferably a straight line parallel to the rotation axis giving rise to a cylinder having a constant circular section; however, other cylindrical shapes are considered to be within the invention under the preceding definition, such as a frustoconical shape or shapes having other variations in radius. In the specific case of a frustoconical shape, the preferred examples have a very small degree of inclination.

The impermeable sheet element is arranged between the first portion and the second portion such that in the event of any heterogeneity of any of the portions of the cork body, this sheet element forms a barrier that prevents diffusion or migration of liquid or gas between the inside and the outside of the container.

This sheet element is preferably manufactured in plastic, so its dimensional parameters are controlled by the manufacturing process, in this case by molding, which results in better dimensional control than that obtained with a heterogeneous material such as cork.

According to preferred embodiments, this sheet element is prolonged around the perimeter in an annular body covering the walls of the first portion and of the second portion at least in a segment close to the longitudinal position of the sheet element.

This annular body has several functions. A first function is to conceal the attachment between the sheet element and each of the portions of the cork body, preventing contaminants from entering. A second function is to limit the entry of the cap into the opening of the container, establishing an insertion position that is always the same. Therefore, not only is the same closure always established during manufacture, but rather the user can open and close the container establishing the closure under the same conditions every time they close it.

DESCRIPTION OF THE DRAWINGS

These and other features and advantages of the invention will be more clearly understood based on the following detailed description of a preferred embodiment given only by way of non-limiting illustrative example in reference to the attached drawings.

DETAILED DISCLOSURE OF THE INVENTION

According to the first inventive aspect, the present invention relates to a cap for covering an opening of a container, preferably a bottle.

Figure 1:
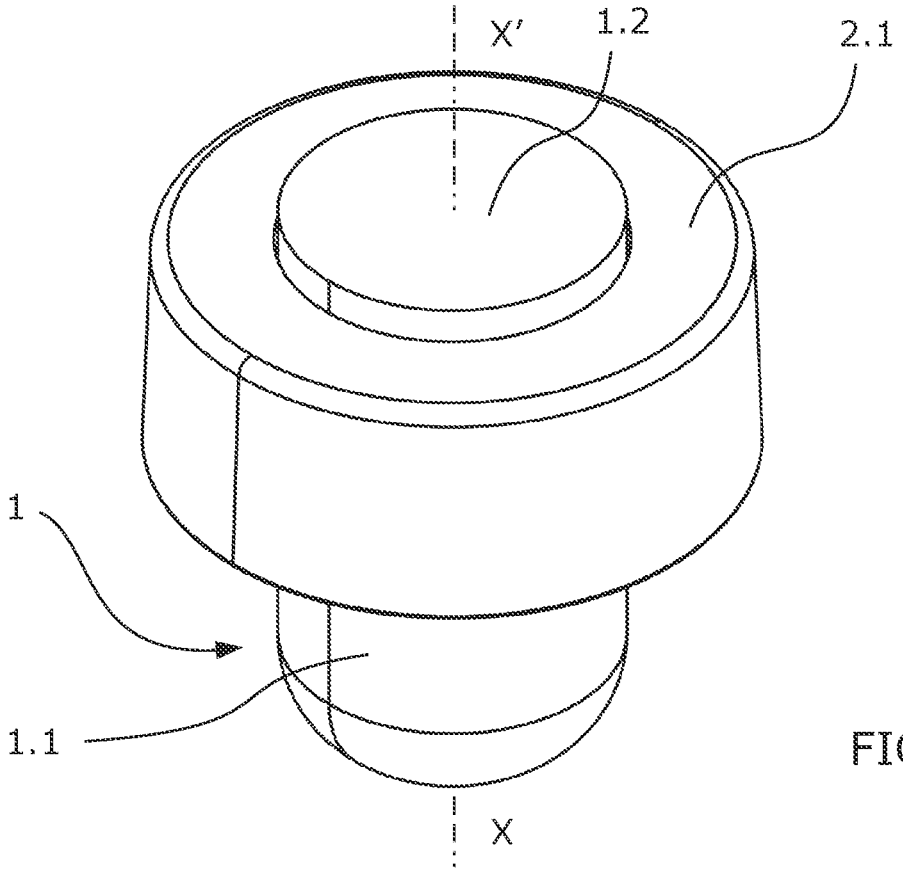
FIG. 1 shows a perspective view of a preferred example of the invention.

FIG. 1 shows a perspective view of a first embodiment of the cap, wherein its longitudinal direction (X-X') is shown as being vertical according to the orientation chosen in the figure.

Hereinafter, where relative terms defining the position are used such as lower, upper, right, or left, they will all be in reference to the chosen orientation when showing the specific figure which is being described.

The cap comprises a cork body (1) which can be observed both in the upper part and in the lower part of the figure, being visually interrupted by an annular body (2.1).

Figure 2:
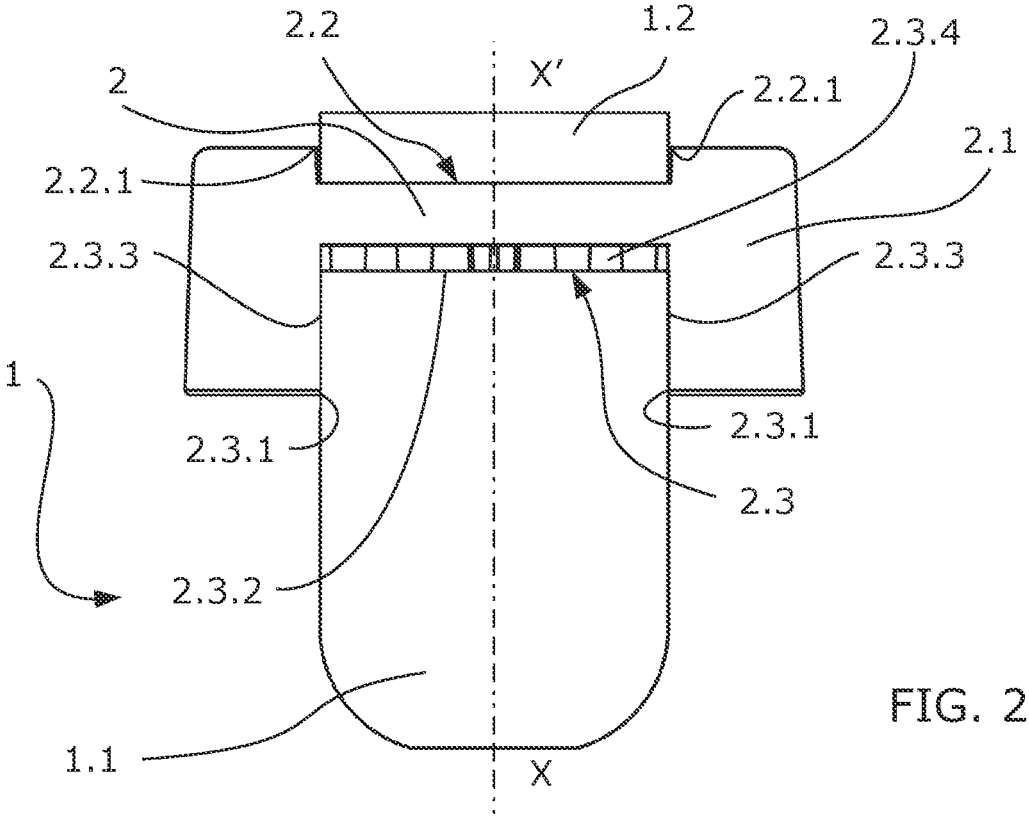
FIG. 2 shows a section view according to a plane passing through the main axis of the cap of the same preferred example of the invention.

To show the structure of this embodiment in greater detail, FIG. 2 shows a section according to a plane passing through the longitudinal axis (X-X'). In view of this section, it can be observed that the cork body (1) has a cylindrical configuration extending along the longitudinal direction (X-X') and that it is formed by two portions, a first portion (1.1) located in the lower part and a second portion (1.2) located in the upper part.

In the operative mode, the lower first portion (1.1) is inserted into the neck of the container such that the cork walls of this first portion (1.1) establish pressure against the walls of the neck of the container, establishing the closure and the retention of the cap.

The second portion (1.2) is accessible from the outside. Between the first portion (1.1) and the second portion (1.2) there is an impermeable sheet element (2) preventing the passage of liquid or gas therethrough. If the first portion (1.1) and the second portion (1.2) have any type of cavity or crack, they would allow the passage of liquid or gas which, in this case, is blocked by the barrier established by the sheet element (2).

FIG. 2 shows an embodiment with a specific configuration, wherein the sheet element (2) extends around the perimeter by means of an annular body (2.1).

The annular body (2.1) in this case has a quasi-rectangular section extending in the upper and lower parts above and below, respectively, the main plane of the sheet element (2).

The lower surface of the annular body (2.1) acts as a stop when the cap is inserted into the neck of the bottle, whereby serving as an insertion limit.

Another function of the annular body (2.1) is to protect the attachment between each of the portions (1.1, 1.2) of the cork body (1) and the sheet element (2).

In this embodiment, the sheet element (2) and the annular body (2.1) form a first cylindrical cavity (2.2) intended for housing the lower part of the second portion (1.2) of the cork body (1). This housing makes it difficult to access the attachment surface between the second portion (1.2) and the sheet element (2) from the outside.

Furthermore, the side walls of the first cylindrical cavity (2.2) are configured by means of a first step (2.2.1), wherein the wall of the cylindrical cavity 2.2) protects the attachment surface between the second portion (1.2) and the sheet element (2). According to this embodiment, this same wall is slightly wedged to facilitate both operation of removing the sheet element (2) with its annular body (2.1) from the mold and the insertion by pressure of the second portion (1.2) of the cork body (1).

There is also formed between the sheet element (2) and the annular body (2.1) a second cylindrical cavity (2.3) in the lower part intended for receiving the first portion (1.1) of the cork body (1).

In this embodiment, the base (2.3.2) of the second cylindrical cavity (2.3) contains ribs which are in turn made up of circular ribs (2.3.4) and radial ribs (2.3.5).

One of the functions of these ribs (2.3.4, 2.3.5) is to define spaces or cavities at the base (2.3.2) which allows receiving adhesive for the attachment between the first portion (1.1) and said base (2.3.2) without this adhesive extending through the interface and reaching areas which may have access to the liquid stored in the container when the amount of adhesive is not suitable.

According to this embodiment, the second cylindrical cavity (2.3) is configured by means of smooth side walls (2.3.3) that are slightly wedged to receive the first portion (1.1) of the cork body (1). The closure between this first portion (1.1) of the cork body (1) and the annular body (2.1) is established by means of a second step (2.3.1) of the annular body (2.1) which prevents access to the attachment surface between the first portion (1.1) of the cork body (1) and the base (2.3.2) of the second cylindrical cavity (2.3) even though the cap has not been inserted into the neck of the container.

Figure 3:
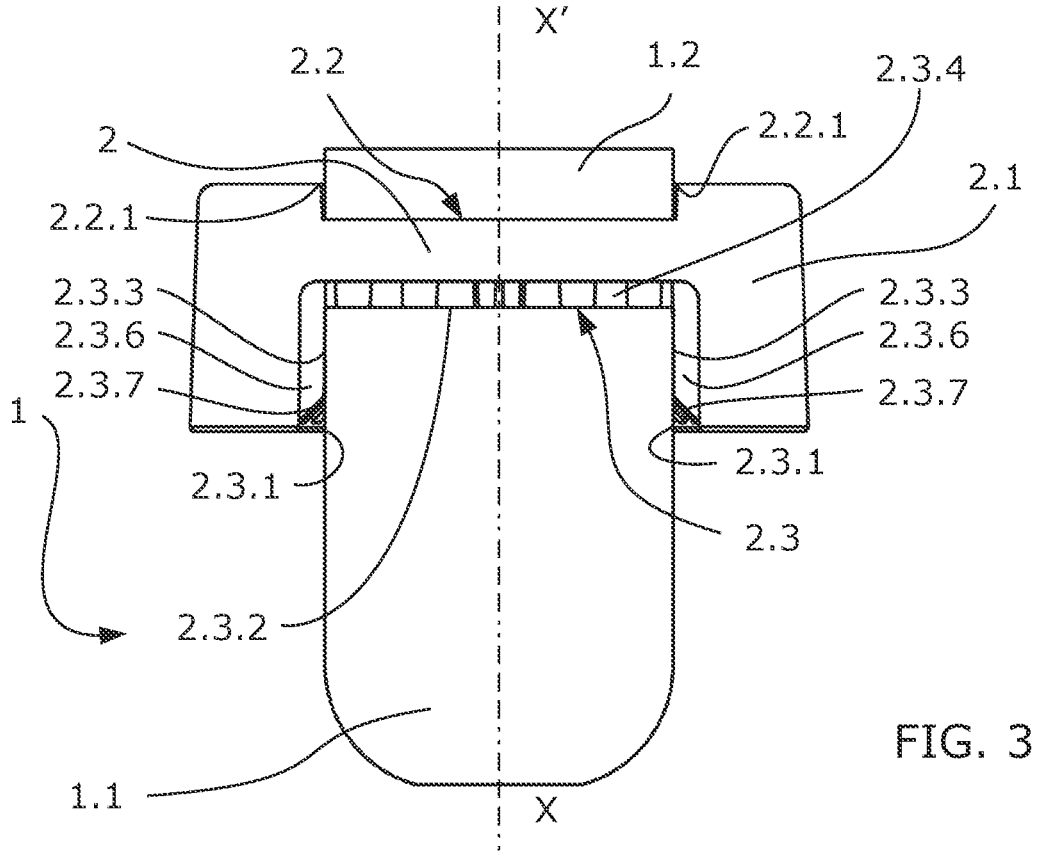
FIG. 3 shows a section view of another example of the invention, this section being according to a plane passing through the main axis.

FIG. 3 shows a preferred embodiment which has all the elements it shares in common with the embodiment shown in FIG. 2 except the configuration of the side wall (2.3.3) of the second cavity (2.3). This side wall (2.3.3) of this embodiment comprises ribs (2.3.6) parallel to the longitudinal direction (X-X') which come into contact with the first portion (1.1).

According to this embodiment, these parallel ribs (2.3.6) show a beveled entry (2.3.7) that facilitates insertion of the first portion (1.1).

Figure 4:
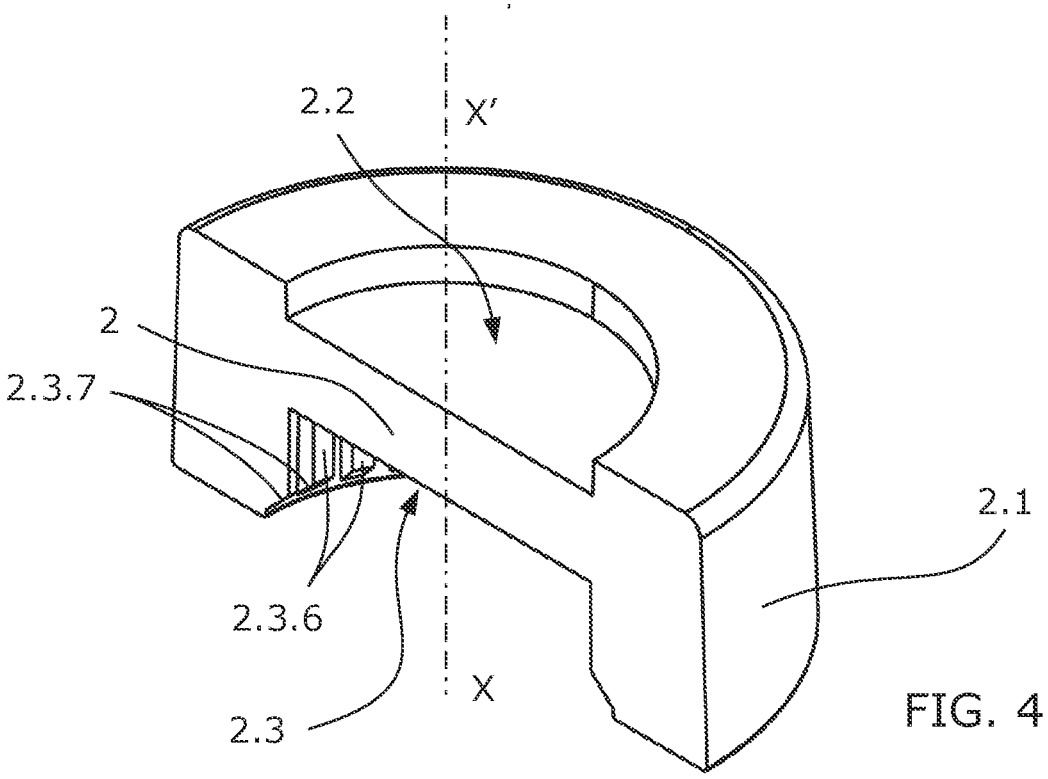
FIG. 4 shows a perspective view of a section of only the sheet element of the example shown in FIG. 3 with the perimetral extension in an annular body, in which said element is sectioned according to a plane passing through the main axis of the cap.

FIG. 4 shows a sectioned perspective view of the sheet element (2) with the annular body (2.1) wherein it can be observed that the section of the parallel ribs (2.3.6) of the side wall (2.3.3) of the second cylindrical cavity (2.3) is rectangular.

This section offers support bands against the side wall of the first portion (1.1) of the cork body (1), facilitating insertion during manufacture, and wherein in this embodiment they are also used to increase pressure in these support regions.

Figure 5:
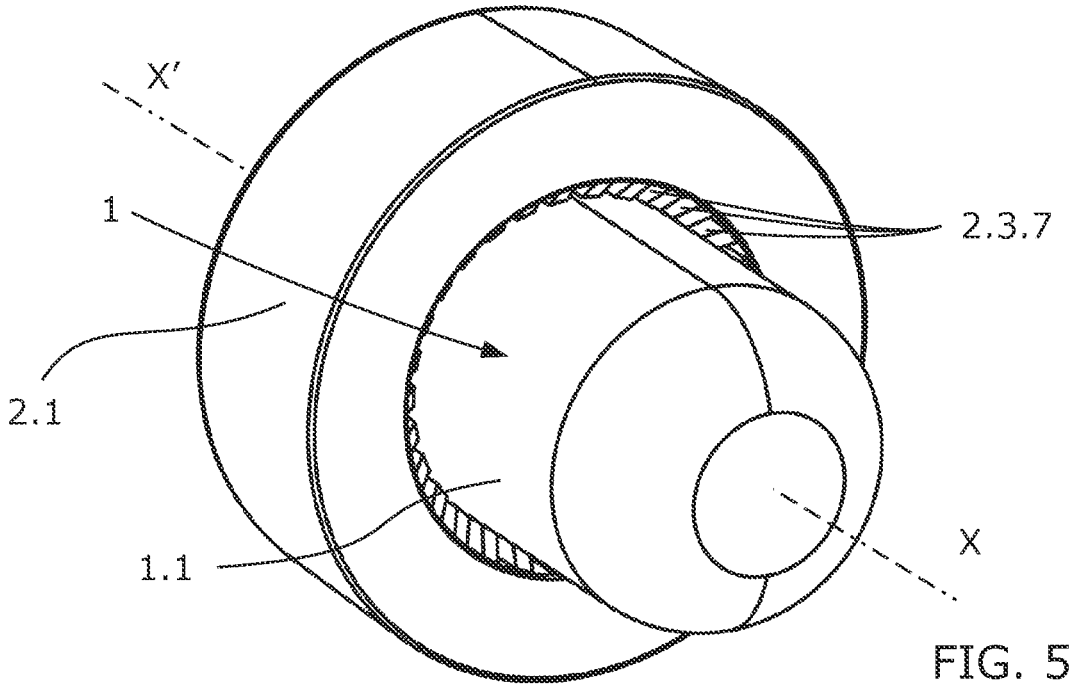
FIG. 5 shows a perspective view of the complete cap using the sheet element of the example in the preceding figure.

FIG. 5 illustrates the relationship between the parallel ribs (2.3.6) with their bevel (2.3.7) and the first portion (1.1), leaving passage channels between said parallel ribs (2.3.6).

Figure 6:
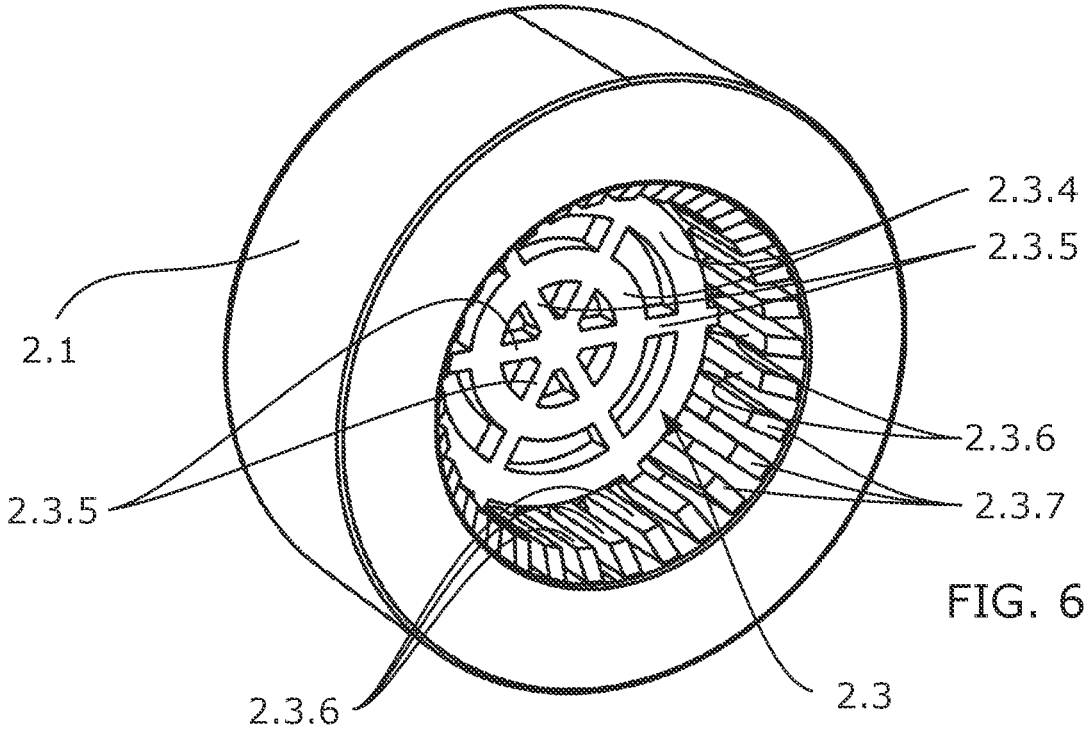
FIG. 6 shows the same perspective view as in the preceding figure of the same embodiment, in which the cork body has been removed to visually observe the configuration details of the sheet element and its annular body.

FIG. 6 shows the same perspective view wherein the first portion (1.1) has been removed to have visual access to the base (2.3.2) of the second cylindrical cavity (2.3) and to thus observe the structure of spaces and cavities resulting from configuring said base (2.3.2) with circular ribs (2.3.4) and radial ribs (2.3.5).

Figure 7:
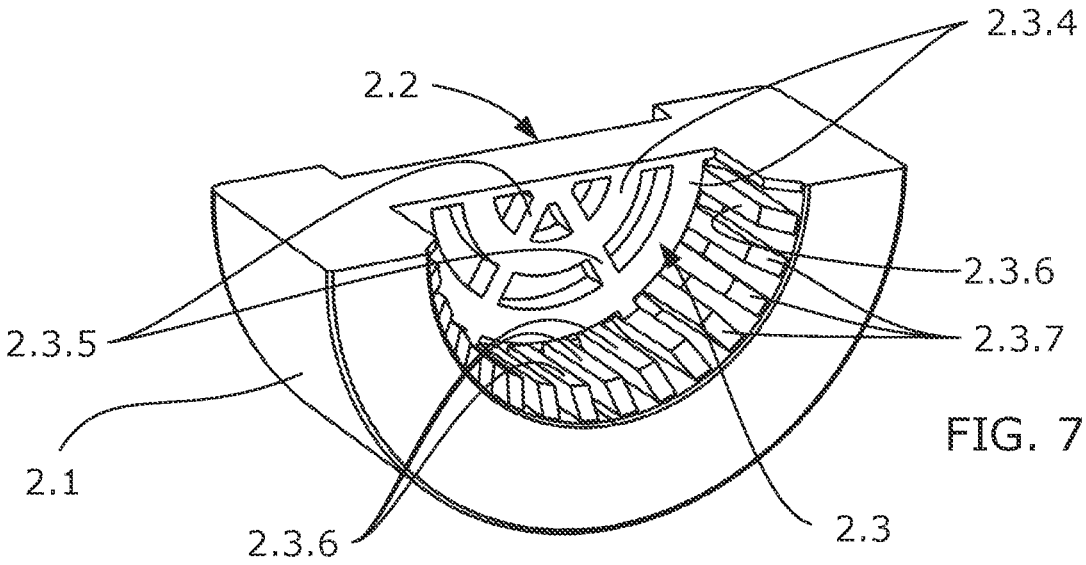
FIG. 7 shows the same piece from the perspective view of the preceding figure, only this one has been sectioned according to a plane of section passing through the main axis.

FIG. 7 shows the same perspective view except that the piece has been sectioned so that the first cylindrical cavity (2.2) can also be observed.

According to the described embodiments, the sheet element (2) with the extension in the form of an annular body (2.1) is configured as a single piece in a rigid material, preferably plastic, so as to allow its manufacture by molding.

According to the described embodiments, the first portion (1.1) and the second portion (1.2) are attached by adhesive to the corresponding bases (2.2, 2.3) of the cavities housing them.

The invention claimed is:

1. A cap for covering an opening of a container, preferably a bottle, comprising:

a cork body having a cylindrical configuration extending along a longitudinal direction, wherein the cork body comprises a first cork portion intended for being inserted into the opening of the container and a second cork portion intended for being accessible from the outside when the cap closes the opening of the container in the operative mode;

an impermeable sheet element arranged between the first cork portion and the second cork portion, configured to prevent the passage of a fluid or gas between the first cork portion and the second cork portion.

2. The cap according to claim 1, wherein the sheet element is made of a rigid material.

3. The cap according to claim 1, wherein the sheet element extends around the perimeter by means of an annular body intended for being supported on the opening of the container when the cap is closing said opening in the operative mode, wherein the annular body:

either partially covers a perimetral portion of the first cork portion of the cork body;

or partially covers a perimetral portion of the second cork portion of the cork body;

or both.

4. The cap according to claim 3, wherein the annular body partially covers a perimetral portion of the second cork portion of the cork body giving rise to a first cylindrical cavity with a first step finished at an angle, and with the edge of the angle of the first step in contact with the perimetral wall of the cork body establishing the closure with the perimetral wall of the second cork portion of the cork body.

5. The cap according to claim 3, wherein the annular body partially covers a perimetral portion of the first cork portion of the cork body giving rise to a cylindrical cavity with a second step finished at an angle, and with the edge of the angle of the second step in contact with the perimetral wall of the first cork portion of the cork body.

6. The cap according to claim 5, wherein the second step establishes the closure with the perimetral wall of the first cork portion of the cork body.

7. The cap according to claim 3, wherein the annular body partially covers a perimetral portion of the first cork portion of the cork body giving rise to a cylindrical cavity with the wall of the cylindrical cavity spaced from the first cork portion of the cork body.

8. The cap according to claim 7, wherein the wall of the second cylindrical cavity is spaced from the first cork portion of the cork body by means of ribs, either located at the base of the second cavity, or located at the side wall of the second cavity, or is located at both.

9. The cap according to claim 8, wherein the base of the second cavity has concentric circular ribs and radial ribs generating cavities at said base.

10. The cap according to claim 1, wherein the attachment between the first cork portion and the annular body, the attachment between the second cork portion and the annular body, or both attachments is by means of adhesive.

11. The cap according to claim 8, wherein the side wall of the second cavity has ribs parallel to the longitudinal direction.

12. The cap according to claim 11, wherein the ribs parallel to the longitudinal direction have a bevel to facilitate insertion of the first cork portion of the cork body into the annular body.

13. The cap according to claim 4, wherein the first cavity, the second cavity, or both have the side walls wedged to increase pressure on the cork portions housed therein.

* * * * *